United States Patent [19]

Fessler

[11] Patent Number: 4,577,782

[45] Date of Patent: Mar. 25, 1986

[54] BEVERAGE DISPENSING STATION

[75] Inventor: Herman S. Fessler, Coon Rapids, Minn.

[73] Assignee: The Cornelius Company, Anoka, Minn.

[21] Appl. No.: 492,870

[22] Filed: May 2, 1983

[51] Int. Cl.[4] ..... B67D 5/56

[52] U.S. Cl. ..... 222/129.1; 222/182; 222/505; 312/223

[58] Field of Search ..... 222/182, 183, 129, 129.1, 222/132, 144.5, 135, 511, 513, 514, 399, 394, 505, 504; 312/223, 35, 42; 251/89, 107, 108, 101

[56] References Cited

U.S. PATENT DOCUMENTS

| | | | |
|---|---|---|---|
| 2,448,306 | 8/1948 | Gottlieb | 222/129.1 |
| 3,130,873 | 4/1964 | Klutz, Jr. | 222/132 |
| 3,195,779 | 7/1965 | Nicko | 222/129.1 |
| 3,266,672 | 8/1966 | Dean | 222/129.1 |
| 3,349,967 | 10/1967 | Schneller | 222/135 |
| 3,934,427 | 1/1976 | Keyes | 222/135 |
| 3,942,685 | 3/1976 | Lindner | 222/129.1 |

*Primary Examiner*—Joseph J. Rolla
*Assistant Examiner*—Kenneth Noland
*Attorney, Agent, or Firm*—Henry C. Kovar

[57] ABSTRACT

A beverage dispensing station has a chassis mounted on a panel of a dispensing machine, a dispensing head on the chassis, dispensing actuators mounted on the panel, selector buttons mounted to the panel and pivotally suspended on a horizontal axis hinge with there being one button for each actuator, a bracket on the chassis which has a ledge for restraining the buttons and a flange for flow controls and a clamp for beverage lines, and a cover removably mounted to the chassis; the cover is removable for access to the flow controls and the bracket is forwardly deflectable for releasing the buttons and enabling removal of valve elements from the preferred actuator which is a pneumatic valve.

16 Claims, 3 Drawing Figures

BEVERAGE DISPENSING STATION

BACKGROUND OF THE INVENTION

1. Field of the Invention

This invention pertains to a dispensing station for dispensing beverages such as soft drinks.

2. The Prior Art

A typical example of prior art is a dispensing machine with a separate drip tray and a discrete dispensing valve for each flavor. Another example would be a vending machine that vends a cup and then fills the cup with beverage. The typical prior art is either completely mechanical or is electro-mechanical.

The prior art is specifically commercial and is not suitable for use in a household.

OBJECTS OF THE INVENTION

It is an object of the present invention to provide a non-electrical multiple flavor beverage dispensing station.

It is an object of the present invention to provide an improved sanitary, attractive, and safe beverage station specifically for use in a household.

It is an object of the present invention to provide an improved beverage dispensing station having a chassis and a removable cover enclosing working components.

It is an object of the present invention to provide a pneumatically powerable beverage dispensing station.

SUMMARY OF THE INVENTION

In accordance with the principles of the present invention, an improved beverage dispensing station has a chassis, a beverage dispensing head supported by the chassis, beverage lines which are above a chassis underpanel and which lead to the head, a removable cover removably mounted upon the chassis, and beverage selector buttons mounted inside of the cover, the buttons being registered with and being accessible through apertures in the cover, the buttons being operable when the cover is removed.

AS SHOWN ON THE DRAWINGS

Figure 1:
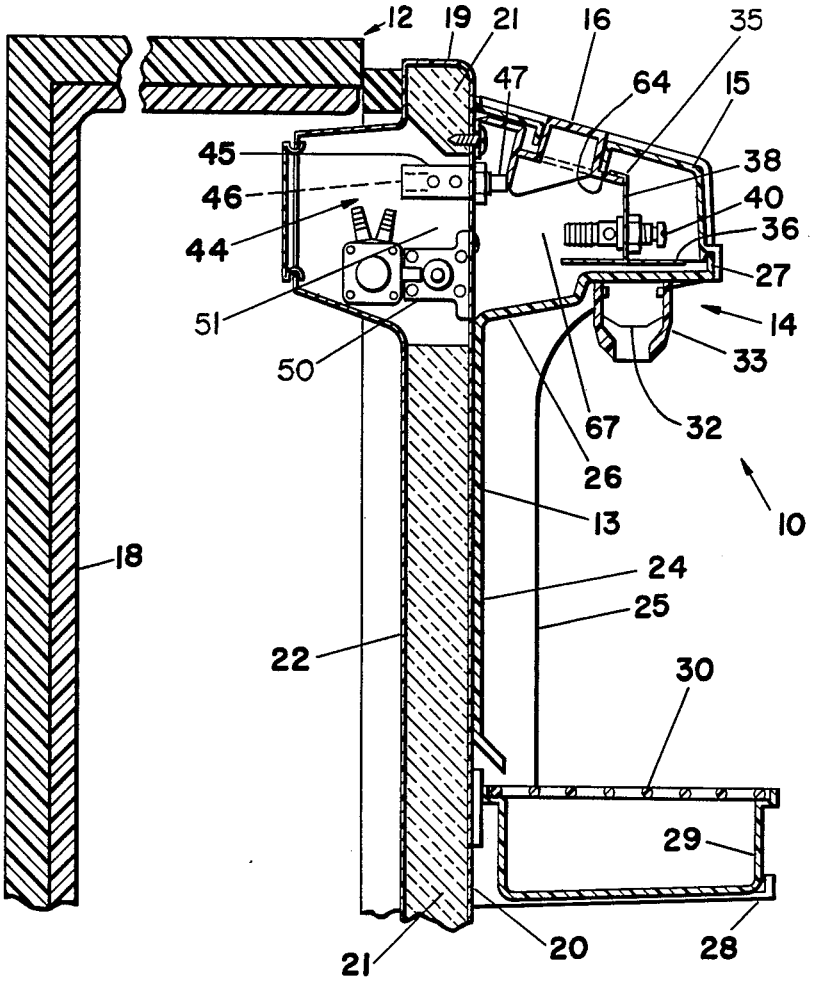
FIG. 1 is an elevational side view, in section, of the preferred embodiment of a beverage dispensing station according to the principles of the present invention.

The principles of the present invention are particularly useful when embodied in a beverage dispensing station, generally indicated by the numeral 10 and shown mounted on a beverage dispensing machine 12. The station 10 includes a chassis 13, a beverage dispensing head 14, a cover 15, and selector buttons 16.

The dispensing machine 12 may have a refrigerated cabinet 18 with an openable door 19 having a front panel 20 backed up by thermal insulation 21 and an inside panel 22. Alternatively, the front panel 20 may be a panel on any kind of a beverage dispenser, such as the type of dispensers seen in restaurants and theaters.

The chassis 13 is the structural backbone of the station 10 and has a splash panel 24 and a pair of vertical side ribs 25 which structurally connect an upper underpanel 26 and a bottom tray support 28. The underpanel has a surrounding rim 27 and the tray support 28 forms a nest to support a drip tray 29 and a cup rest 30. The beverage dispensing head 14, which is the actual outlet for beverage, is supported by the underpanel 26. The head 14 has a nozzle 32 secured to the underpanel 26 and a removable spout 33. A preferred dispensing head is disclosed in U.S. Pat. No. 4,218,014.

The nozzle 32 is held in the underpanel 26 by a bracket 35 which has a base flange 36 secured by screws 37 in the underpanel 26. The bracket 35 has an up flange which serves as a mount for adjustable beverage flow controls 40. Beverage lines 41 connect the flow adjustors 40 to the dispensing head 14 and the bracket 35 has a central confinement clamp 42 over the top of the head 14 and the lines 41 which holds the lines 41 down and out of the selector buttons 16.

The preferred dispensing actuators 44 are pneumatic valves. Each actuator 44 has a housing or body 45 mounted in and behind the front panel 20. At the rear of the valve body 45 is a gas vent 46 which exhausts into the inside of the dispensing machine 12. Within the valve housing 45 is a spool type valve element 47 which is biased outward by a spring 48. Just below the actuators 44 is a pneumatic servo-actuated water valve 50 to which all of the actuators 44 are fluidly connected. Each actuator 44 is discretely connected to a remote source of beverage syrup. Alternatively, the actuators in some dispensing machines are electric switches. Regardless, when a selector button 16 is depressed, a flow of water and a flow of a selected syrup is delivered to the head 14.

Each selector button 16 has an upward facing finger pad 53 and a foot 54 in contact with the actuator valve element 47. All of the selector buttons 16 are pivotally suspended by a plastic flex hinge 55 from a common mounting pad 56. The buttons 16, hinge 55 and mounting pad 56 are integral and of one piece of plastic with the buttons 16 being segmented from each other. The mounting pad 56 is fastened to the front panel 20 by fasteners 57 so that the hinge 55 is in a horizontal axis above the actuators 44. The included angle between the finger pad 53 and foot 54 as measured from the hinge 55 is about sixty degrees and the force applied to the finger pad 53 is almost directly downward rather than rearward so that the dispensing machine 12 does not tend to move rearward when the buttons 16 are depressed. Each button 16 has a toe 58 which abuts against a bracket ledge 59 when the cover 15 is removed. The spring-loaded actuator elements 47 bias the button 16 upwardly and the ledge 59 holds the button 16 down and keeps the valve elements 47 in the actuators 44.

The cover 15 has a top panel 60 with a front 61 and sides 62 that overlap inside and outside in engagement with the chassis underpanel rim 27. The top panel has apertures 63 through which the buttons 16 protrude and each aperture 63 has a button stop 64 that positions the buttons 16 when the cover 15 is in place. The cover 15 is held upon the chassis 13 by fasteners 65 which extend through the cover 15 and into the chassis 13.

The cover 15 and chassis underpanel 26 jointly form an internal stagnant air space 67 which is directly in front of a void 51 in the insulation; the actuators 44 and servo valve 50 being in the insulation void 51. Within the stagnant air space 67 are the various components as previously described. The air space 67 also reduces heat loss out of the cabinet 18 from the insulation void 51 and the actuators 44, and enables the beverage lines 41 to remain at a temperature below ambient and prevents condensation on the actuators 44, the front panel 20 and the beverage lines 41.

Figure 2:
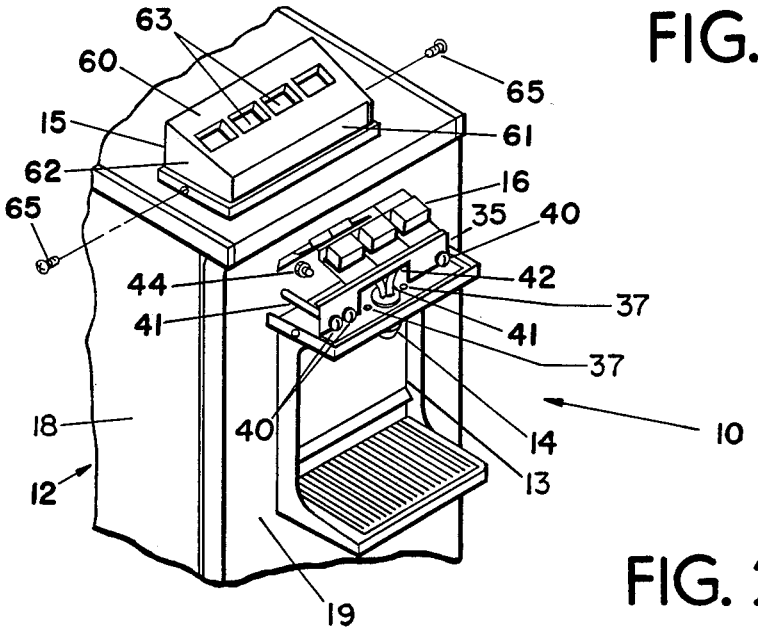
FIG. 2 is a perspective view looking down at the front of the structure of FIG. 1, with the cover removed and one of the selector buttons released for access to a respective actuator.
Figure 3:
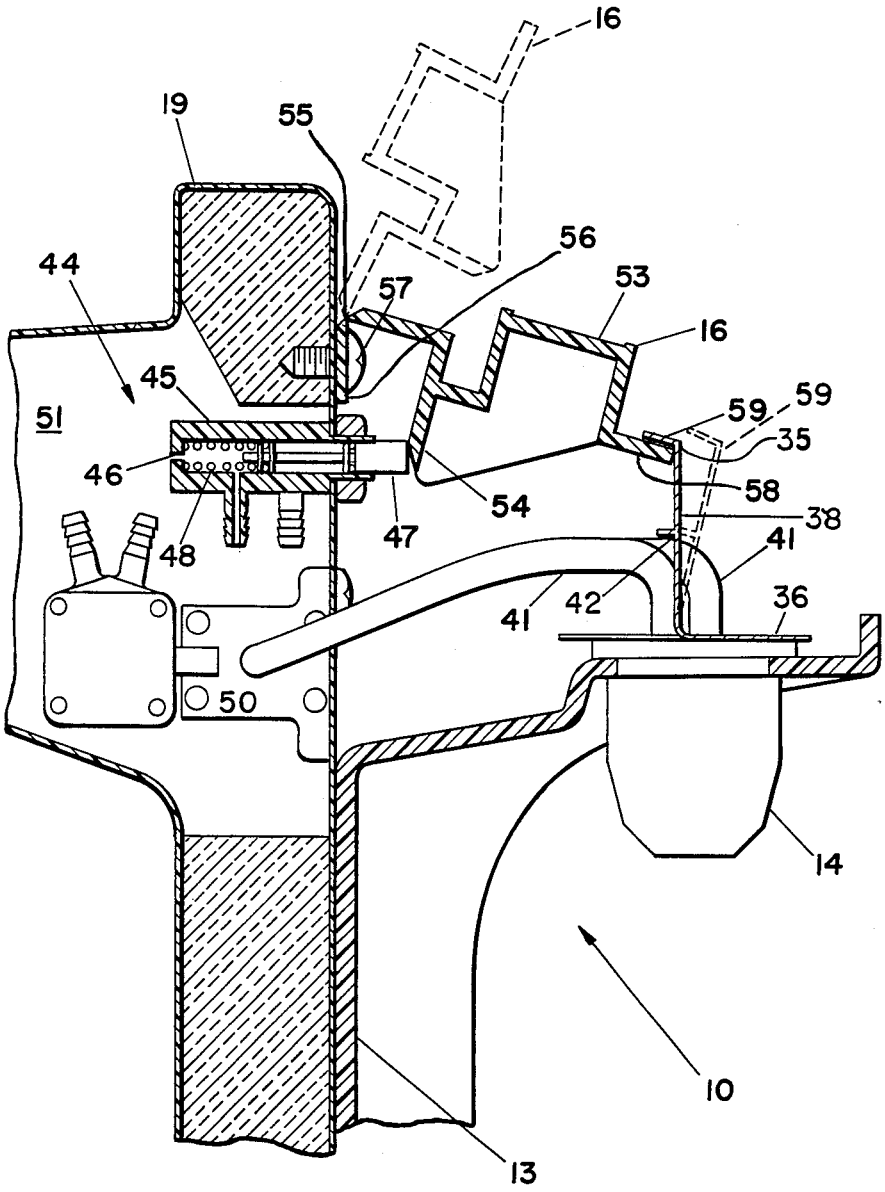
FIG. 3 is a detail from FIG. 1.

The chassis 13 is semi-permanently fastened to the front panel 20 and does not remove from the dispensing machine 12. The drip tray 29 is removable for emptying and the cover 15 is removable for adjustment of the beverage flow rates and for access to the actuators. By deflecting the bracket up flange 38 and ledge 59 forward, the button toes 58 snap upward and the buttons 16 are released upward. The valve elements 47 are then removable directly out the front for replacement of seals and/or cleaning and lubrication. Release of the left selector button 16 is shown in FIG. 2.

The improved dispensing station 10 is very sanitary, very damage resistant, quite attractive, very pleasant to use, it does not sweat with condensate, and adjustments, cleaning and repair are very easy. The station 10 is of relatively modest cost and is ideally suited for a domestic beverage dispensing machine.

Although other advantages may be found and realized, and various and minor modifications suggested by those versed in the art, be it understood that I wish to embody within the scope of the patent warranted hereon, all such embodiments as reasonably and properly come within the scope of my contribution to the art.

I claim as my invention:

1. A beverage dispensing machine having an improved beverage dispensing station mounted upon a panel of the machine, comprising (a) a chassis mounted upon the panel;

(b) a beverage dispensing head supported from the chassis;

(c) beverage lines leading from the panel to the head, said lines being above an underpanel of the chassis;

(d) a cover removably mounted upon the chassis, said cover having apertures for selector buttons and means for enclosing the beverage lines;

(e) beverage selector buttons mounted to the panel by a horizontal axis hinge underneath and inside of the cover, said buttons being registered with and being accessible through respective apertures and being operable when the cover is either mounted upon or removed from the chassis, said buttons being movable to an alternative position for withdrawal of valve elements normally operable by the buttons, and (f) means under the cover and mounted to the machine independently of the cover for normally restraining the selector buttons against the valve elements when the cover is removed.

2. The improvement of claim 1, in which the selector button hinge is mounted to the panel and in which the restraining means comprises a bracket mounted to the chassis.

3. The improvement of claim 2, in which the bracket has a ledge extending over the top of a toe on each selector button.

4. The improvement of claim 1, in which the cover has a selector button stop which normally engages each button.

5. The improvement of claim 1, in which the restraining means also has means for restraining the dispensing head in the chassis.

6. The improvement of claim 1, in which the restraining means includes a confinement clamp for confining the beverage lines, and for keeping the lines out of the selector buttons.

7. The improvement of claim 1, including a beverage flow adjustor mounted in the selector button restraining means and underneath the cover, said restraining means being mounted to said chassis.

8. A beverage dispensing machine having an improved beverage dispensing station mounted upon a panel of the machine, comprising (a) a chassis mounted upon the panel;

(b) a beverage dispensing head supported from the chassis;

(c) beverage lines leading from the panel to the head, said lines being above an underpanel of the chassis;

(d) a cover removably mounted upon the chassis, said cover having apertures for selector buttons and means for enclosing the beverage lines;

(e) beverage selector buttons mounted inside of the cover, said buttons being registered with and being accessible through respective apertures and being operable when the cover is either mounted upon or removed from the chassis; and (f) in which the selector buttons are mounted by a horizontal axis hinge underneath the cover, said hinge being a plastic flex hinge inbetween each button and a common mounting pad for all of the buttons, all of said buttons, the hinge and the mounting pad being of integral one-piece construction.

9. The improvement of claim 8, in which the mounting pad is secured to the panel.

10. The improvement of claim 8, in which the hinge is adjacent to the panel and the buttons face generally upward and are downwardly depressable.

11. A beverage dispensing machine having an improved beverage dispensing station mounted upon a panel of the machine, comprising (a) a chassis mounted upon the panel;

(b) a beverage dispensing head supported from the chassis;

(c) beverage lines leading from the panel to the head, said lines being above an underpanel of the chassis;

(d) a cover removably mounted upon the chassis, said cover having apertures for selector buttons and means for enclosing the beverage lines;

(e) beverage selector buttons mounted inside of the cover, said buttons being registered with and being accessible through respective apertures and being operable when the cover is either mounted upon or removed from the chassis;

(f) a horizontal axis hinge mounted to the panel, said buttons being suspended from the hinge;

(g) dispensing actuators mounted in the panel and underneath the hinge; and (h) means on the selector buttons and in physical contact with respective actuators for movement of the actuators.

12. The improvement of claim 11, in which each actuator is a pneumatic valve.

13. A pneumatically actuable beverage dispensing machine having an improved beverage dispensing and control station mounted upon a panel of the machine, comprising (a) a chassis mounted upon the panel;

(b) a beverage dispensing head supported from the chassis;

(c) pneumatic dispensing actuators mounted in the panel, each actuator having a gas vent behind the panel and a valve element removable from the actuator;

(d) a beverage selector and control button for each actuator, each button having a foot in engagement with a respective valve element;

(e) a cover removably mounted on the chassis, said cover having apertures for the buttons;

(f) means under the cover and mounted to the machine independently of the cover for restraining the selector buttons in a normal position with each foot against a respective actuator valve element when the cover is removed from the chassis; and (g) in which each actuator includes a spring which biases the valve element against the foot of the respective selector button, with the selector button feet retaining the valve elements in the actuators.

14. The improvement of claim 13, in which the restraining means are selectively disengageable from the buttons for release of the buttons, said buttons being moveable to an alternative position enabling withdrawal of the valve elements for repair of the actuators.

15. The improvement of claim 13, including a pneumatic servo operated water dispensing valve pneumatically connected to the actuators and mounted on the back side of the panel behind the dispensing station.

16. The improvement of claim 13, in which the panel is the face of an insulated refrigeratable cabinet, said actuators being mounted in a void in cabinet insulation, said chassis and cover jointly defining an enclosed air space directly in front of the actuators and insulation void.

* * * * *